US009488405B2

(12) United States Patent
Lee et al.

(10) Patent No.: US 9,488,405 B2
(45) Date of Patent: Nov. 8, 2016

(54) STORAGE BOX ASSEMBLY AND REFRIGERATOR INCLUDING THE SAME

(71) Applicant: LG ELECTRONICS INC., Seoul (KR)

(72) Inventors: Sangkyu Lee, Seoul (KR); Yoojin Jung, Seoul (KR); Seulki Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/884,413

(22) Filed: Oct. 15, 2015

(65) Prior Publication Data

US 2016/0153699 A1 Jun. 2, 2016

(30) Foreign Application Priority Data

Nov. 28, 2014 (KR) ..... 10-2014-0168616

(51) Int. Cl.

| | |
|---|---|
| ***F25D 23/00*** | (2006.01) |
| ***F25D 23/04*** | (2006.01) |
| ***F25D 25/02*** | (2006.01) |
| ***F25D 23/02*** | (2006.01) |

(52) U.S. Cl.

CPC ..... *F25D 23/04* (2013.01); *F25D 23/025* (2013.01); *F25D 23/028* (2013.01); *F25D 25/025* (2013.01); *A47B 2210/175* (2013.01); *F25D 2500/02* (2013.01)

(58) Field of Classification Search

CPC .... F25D 23/04; F25D 23/025; F25D 23/028; F25D 25/025; F25D 25/00; A47B 2210/175

See application file for complete search history.

(56) References Cited

U.S. PATENT DOCUMENTS

| | | | | |
|---|---|---|---|---|
| 5,040,856 | A * | 8/1991 | Wilkins | F25D 25/025 312/334.21 |
| 5,044,704 | A * | 9/1991 | Bussan | F25D 25/025 312/402 |
| 6,343,477 | B1 * | 2/2002 | Mandel | F25D 17/042 62/186 |
| 2005/0127683 | A1 | 6/2005 | Nam | |
| 2007/0262686 | A1 | 11/2007 | Ji | |
| 2013/0193822 | A1 * | 8/2013 | Nistor | F25D 25/025 312/296 |
| 2013/0257254 | A1 * | 10/2013 | Austin | F25D 25/025 312/404 |
| 2014/0077679 | A1 | 3/2014 | Lee et al. | |

(Continued)

FOREIGN PATENT DOCUMENTS

| | | |
|---|---|---|
| JP | S54 17167 | 2/1979 |
| KR | 20-0172643 Y1 | 4/2000 |

(Continued)

OTHER PUBLICATIONS

European Search Report dated May 4, 2016 issued in Application No. 15196904.5.

Australian Office Action dated Jun. 30, 2016 issued in Application No. 2015246134 (full English text).

*Primary Examiner* — Daniel Rohrhoff

(74) *Attorney, Agent, or Firm* — KED & Associates, LLP

(57) ABSTRACT

The storage box assembly includes a storage box, a box cover seated on a top surface of the storage box, a housing which accommodates the storage box, and an auto closing unit which connects a bottom portion of the storage box with the housing to automatically close the storage box. Here, top ends of both sides of the storage box and bottom ends of both sides of the box cover slant downward toward the rear to be engaged with one another.

15 Claims, 16 Drawing Sheets

(56) References Cited

U.S. PATENT DOCUMENTS

| | | | | |
|---|---|---|---|---|
| 2014/0290302 | A1* | 10/2014 | Shin | F25D 11/022 62/408 |
| 2015/0102717 | A1* | 4/2015 | Furr | F25D 25/025 312/404 |
| 2015/0368021 | A1* | 12/2015 | Ho | B65D 81/2038 206/524.8 |

FOREIGN PATENT DOCUMENTS

| | | | |
|---|---|---|---|
| KR | 10-2010-0066876 | A | 6/2010 |
| KR | 10-2010-0134962 | A | 12/2010 |
| KR | 10-2014-0013718 | A | 2/2014 |
| KR | 10-2014-0121536 | A | 10/2014 |

* cited by examiner

STORAGE BOX ASSEMBLY AND REFRIGERATOR INCLUDING THE SAME

CROSS-REFERENCE TO RELATED APPLICATION

The present application claims of priority under 35 U.S.C. §119 to Korean Patent Application No. 10-2014-0168616 filed on Nov. 28, 2014, whose entire disclosure is hereby incorporated by reference.

BACKGROUND

1. Field

A storage box assembly and a refrigerator including the same are disclosed herein.

2. Background

Refrigerators are home appliances used to keep food refrigerated or frozen for a long time. Refrigerators have been enlarged and have become multifunctional according to a change in dietary life and consumers' diversified tastes. As refrigerators have been enlarged, a plurality of storage spaces are divided and formed in a compartment. Further, to keep food stored in each storage space fresh, an airtight function is necessary to prevent outdoor air penetration.

In the case of a storage space which accommodates a storage box having a drawer shape, a cover member covering an open top surface of the storage box is separated from the storage box to allow the storage box to be withdrawn smoothly. Further, when the storage box is completely inserted into the storage space, the cover member creates a seal with the top surface of the storage box to provide an airtight function inside the storage box.

Korean Patent Publication No. 2008-0125370 (hereinafter, referred to as a cited reference), filed by the applicant of the present disclosure, has been developed to provide aspects described above. However, when a drawer is withdrawn, the drawer cover repetitively tilts forward and backward. During a process of withdrawing the drawer, a front end of the drawer cover contacts a top surface of the drawer resulting in a frictional force.

Further, a front drawer protrusion located close to a front of the drawer may be damaged or may be covered with foreign substances when the drawer is withdrawn completely. Due to the configuration, the drawer cover while seated on the top surface of the drawer generates noise when the drawer is withdrawn. When a user does not completely close the drawer, the top surface of the drawer may not be in completely close contact with the drawer cover to prevent a good seal for air tightness.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
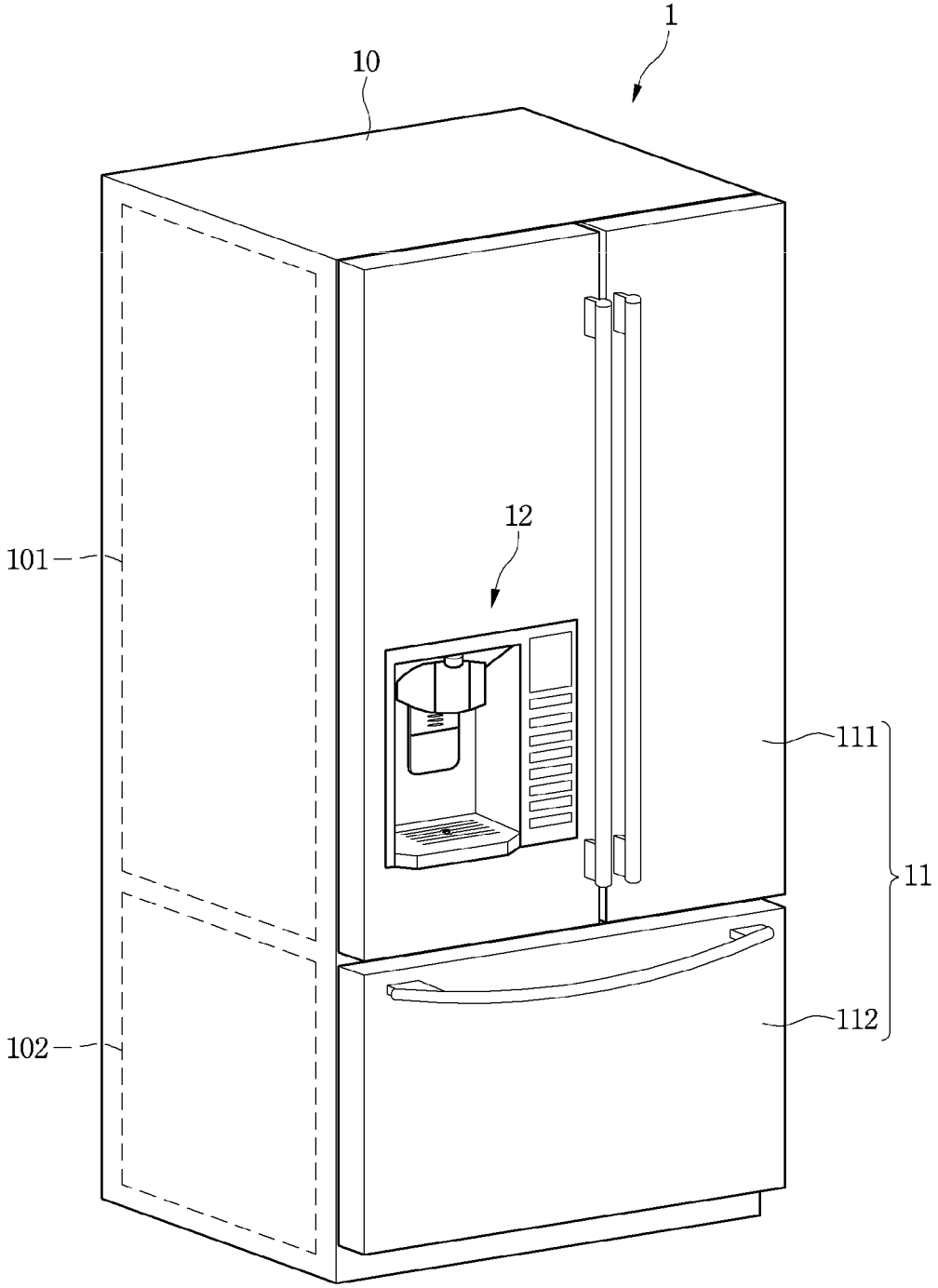
FIGS. 1 and 2 are perspective views of a refrigerator including a storage box assembly according to an embodiment.
Figure 2:
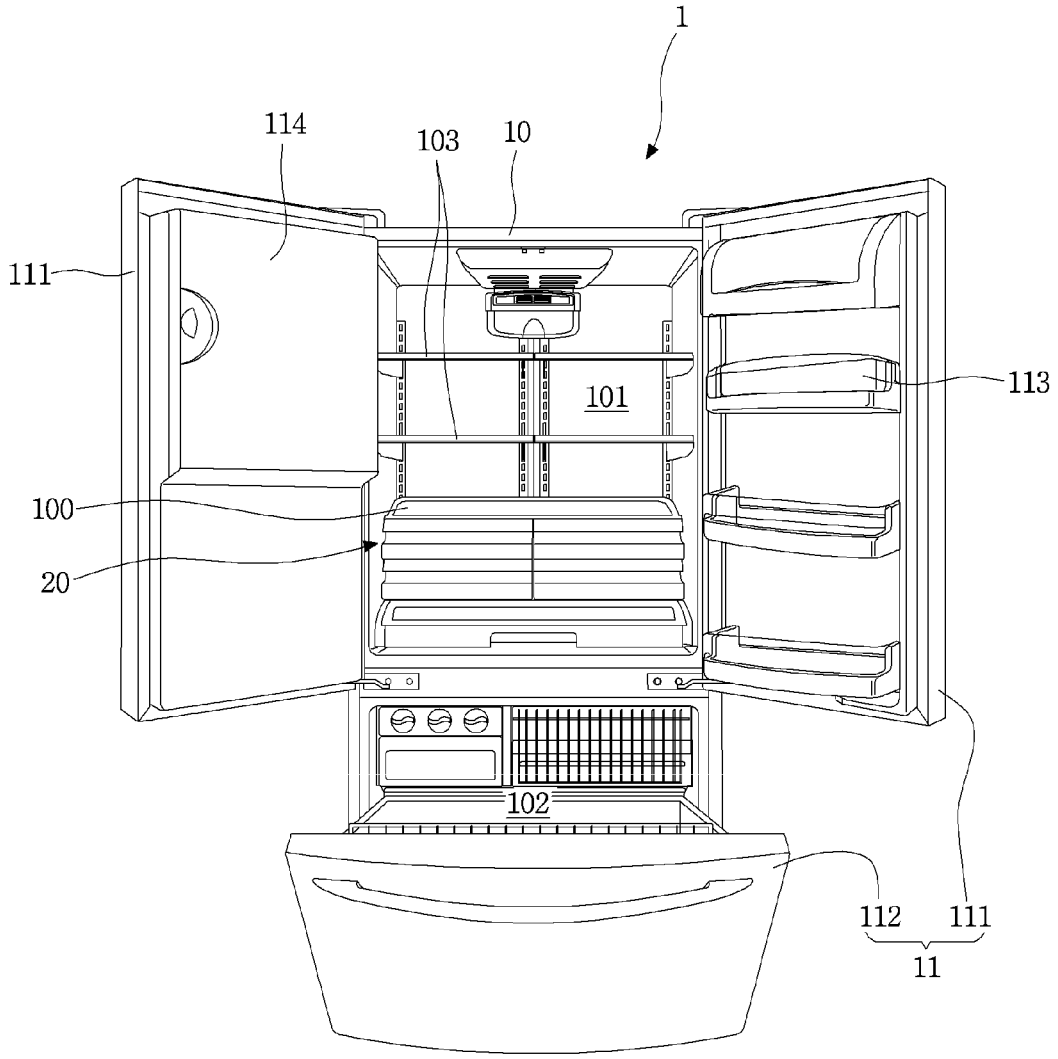

FIGS. 1 and 2 are perspective views of a refrigerator including a storage box assembly 20 according to an embodiment. The storage box assembly 20 may be installed inside at least one of a refrigerating compartment or a freezer compartment. The storage box assembly 20 may be installed in different types of refrigerators including but not limited to a bottom-freezer type refrigerator, a French door type refrigerator, a side-by-side type refrigerator or a top-mount type refrigerator.

The French door may correspond to a pair of pivoting doors which open and close a single storage space. A left door and a right door are pivotably connected to a left edge and a right edge of a refrigerator body and may entirely or partially open the storage space. The bottom-freezer type refrigerator may be a refrigerator where a freezer compartment is disposed below a refrigerating compartment. The side-by-side type refrigerator may be a refrigerator in which a freezer compartment and a refrigerating compartment are adjacently disposed left and right. The top-mount type refrigerator may be a refrigerator in which a freezer compartment is disposed above a refrigerating compartment. A refrigerator 1 having the storage box assembly 20 may include a cabinet 10 having a storage room therein and a door 11 which opens and closes the storage room. The storage room may include a refrigerating compartment 101 and a freezer compartment 102. The door 11 may include a refrigerating compartment door 111 which opens and closes the refrigerating compartment 101 and a freezer compartment door 112 which opens and closes the freezer compartment 102. The refrigerating compartment door 111 is provided with a French door and the freezer compartment door 112 is provided with a drawer type door. However, the present disclosure is not limited thereto. The freezer compartment door 112, as shown in the drawings, may be provided as a drawer type door or may be provided as a pivoting door like the refrigerating compartment door 111.

The storage box assembly 20 may be provided in at least one of the refrigerating compartment 101 or the freezer compartment 102. As shown, a pair of storage box assemblies 20 are disposed in the width direction of the refrigerating compartment 101 and are provided as a single module. However, the single storage box assembly 20 may be installed in at least one of a refrigerating compartment or a freezer compartment of a side-by-side type refrigerator.

The refrigerating compartment door 111 may include a left refrigerating compartment door and a right refrigerating compartment door and an ice-making room 114 may be provided in a rear side of one of a pair of refrigerating compartment doors. A dispenser 12 for allowing ice or water to be extracted may be provided at a front side of the refrigerating compartment door in which the ice-making room 114 is provided. Ice formed at the ice-making room 114 may be extracted through the dispenser 12 without opening the refrigerating compartment door. A plurality of door baskets 113 may be mounted on a rear side of the refrigerating compartment door 111 and may be detachably mounted on the refrigerating compartment door 111.

A plurality of shelves 103 may be vertically arranged at certain intervals inside the refrigerating compartment 101. At least some of the plurality of shelves 103 may be slidably withdrawn forward. A storage table 100 may be horizontally mounted at a point spaced downward at a certain interval from a lowest one of the plurality of shelves 103. The storage table 100 may be fixedly mounted in the refrigerating compartment 101 or may be mounted to be slidably withdrawn forward like the other shelves 103.

The storage box assembly 20 may be installed directly below the storage table 100. When a width of the refrigerating compartment 101 is large enough, a pair of storage box assemblies may be disposed left and right, respectively. Alternatively, when a width of a compartment is relatively small like a side-by-side type refrigerator, a single box assembly may be mounted.

Figure 3:
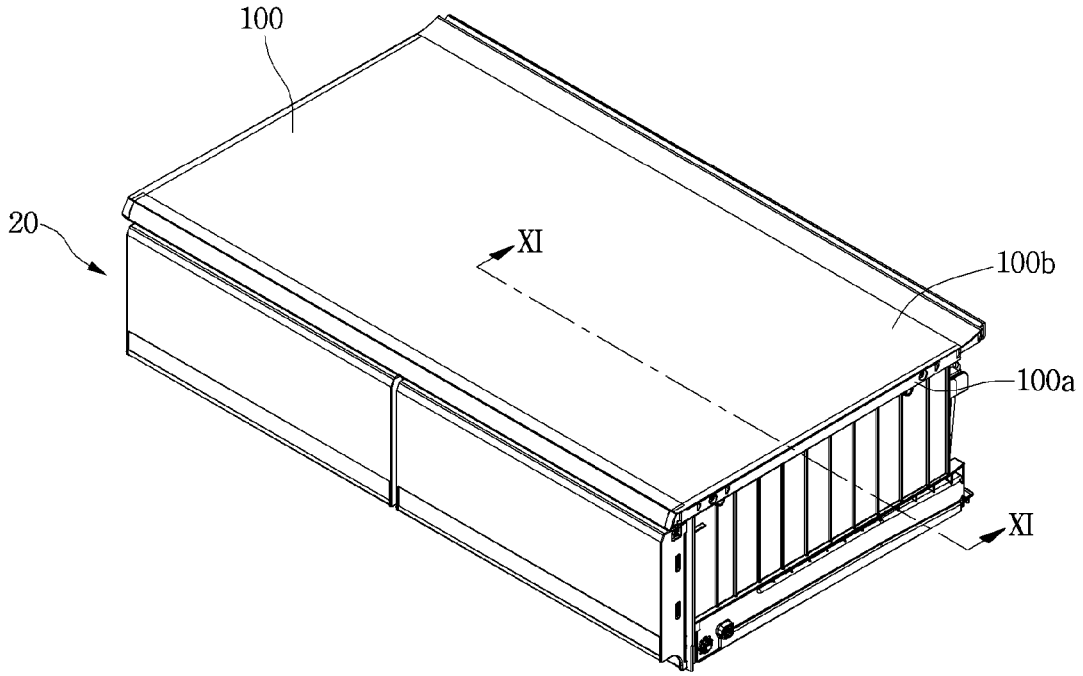
FIG. 3 is a perspective view illustrating an exterior of the storage box assembly according to an embodiment.
Figure 4:
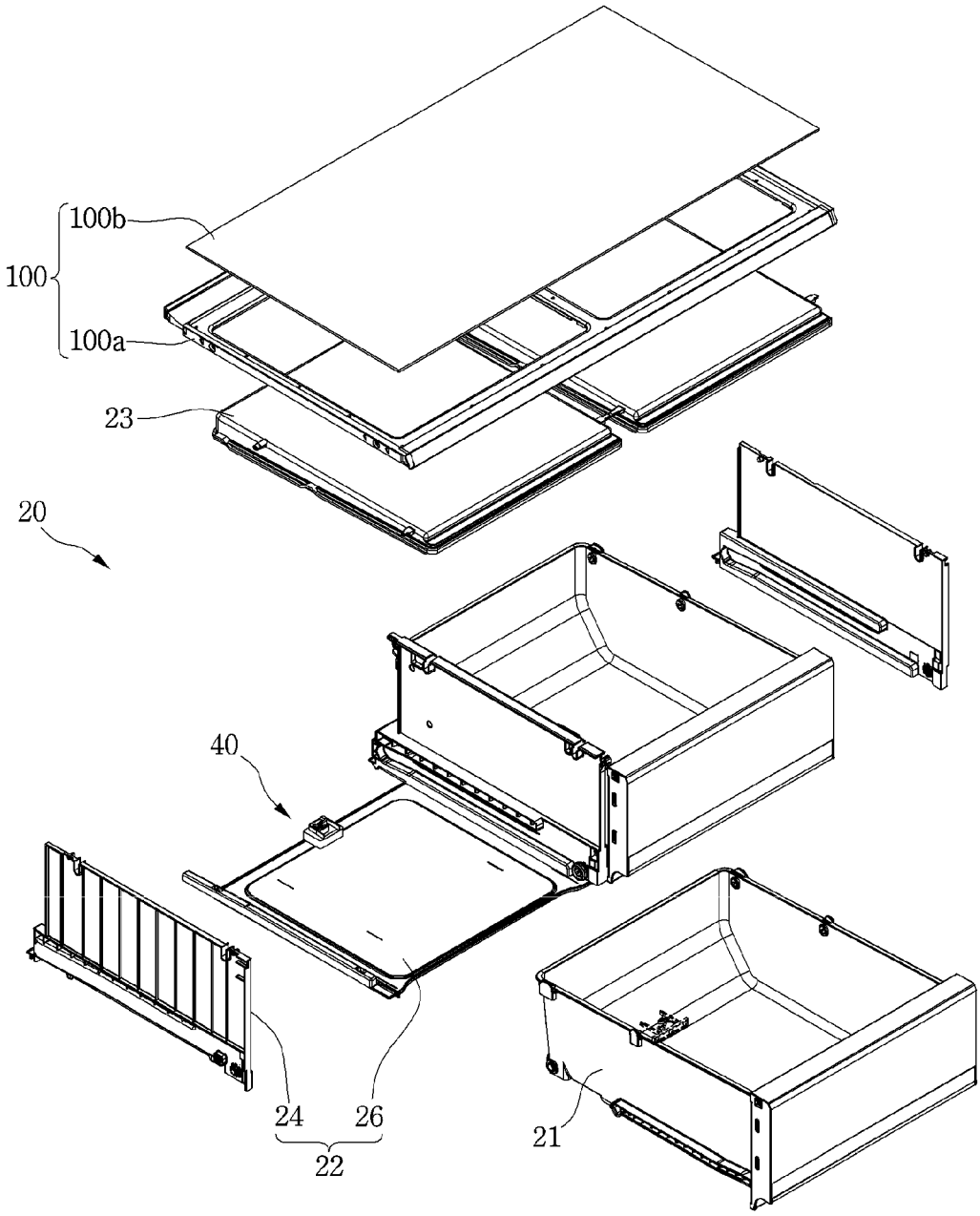
FIG. 4 is an exploded perspective view of the storage box assembly.

FIG. 3 is a perspective view illustrating an exterior of the storage box assembly 20 according to an embodiment. FIG. 4 is an exploded perspective view of the storage box assembly 20. As shown in FIG. 3, the storage box assembly 20 may be disposed below the storage table 100 and the storage table 100 may include a frame 100*a* and a panel 100*b* coupled with a top surface of the frame 100*a*. The panel 100*b* may include a transparent glass panel or a plastic panel.

The storage box assembly 20 may include a storage box 21 in which food is stored, a housing 22 in which the storage box 21 is accommodated to be withdrawable forward, a box cover 23 which is disposed on a top surface of the housing 22 and seals an open top surface of the storage box 21, and an auto closing unit 40 which connects a bottom surface of the storage box 21 with a bottom surface of the housing 22 to allow the storage box 21 to be automatically closed.

The housing 22 may include a base plate 26 on which the auto closing unit 40 is mounted and an upright side wall 24 connected to left and right edges of the base plate 26. When the two storage box assemblies 20 are installed left and right, three upright side walls may be installed at the left edge, the right edge, and the center of the base plate 26. In the case of the side wall located in the center, guide members may be needed to guide the insertion and withdrawal of the storage box 21 on both left and right sides. The auto closing unit or the auto latching mechanism 40 may be mounted in the center of the bottom surface of the storage box 21 or may be mounted on a left edge and a right edge of the bottom surface.

When the storage box 21 is withdrawn forward, the box cover 23 moves upward and is separate from the top surface of the storage box 21. When the storage box 21 is completely inserted into the housing 22, the box cover 23 moves downward to completely close or to be in full contact with the top surface of the storage box 21. When the box cover 23 moves upward or downward, a front end and a rear end of the box cover 23 simultaneously move upward and downward of the same height. Since the box cover 23 does not tilt forward or backward while moving upward or downward, the front end or rear end of the box cover 23 are not in contact with the top surface of the storage box 21.

Figure 5:
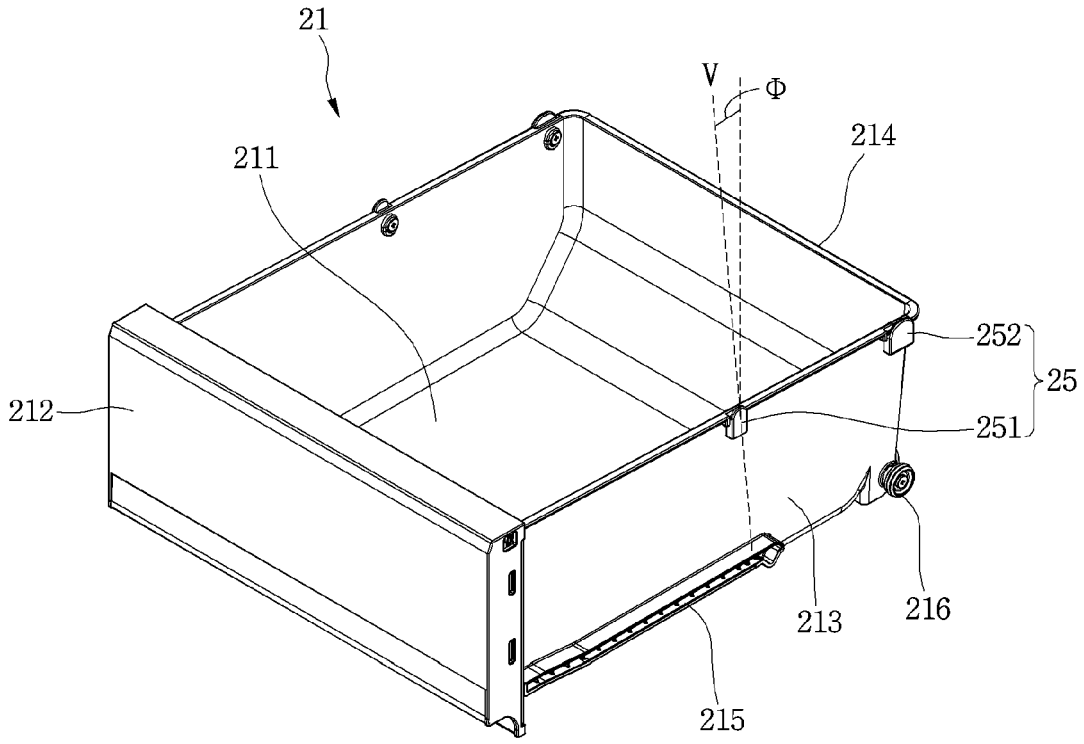
FIG. 5 is a perspective view of a storage box constituting the storage box assembly according to an embodiment.

FIG. 5 is a perspective view of the storage box 21 for the storage box assembly 20 according to an embodiment. The storage box 21 includes a bottom portion or panel 211, a front portion or panel 212 which extends upward from a front end of the bottom portion 211, side portions or panels 213 which extend upward from a left end and a right end of the bottom portion 211, and a rear portion or panel 214 which extends upward from a rear end of the bottom portion 211.

The top surface of the storage box 21 is open to allow a user to store food in the storage box 21 through an opening. The front portion 212 includes a handle formed therein to allow the user to withdraw the storage box 21 using a hand. The auto closing unit 40 may be installed at the left edge and right edge of the bottom portion 211 or in the center of the bottom surface and may be installed in the rear end of the bottom portion 211.

A rail or a rail portion 215 may extend in a direction of the movement of the rail at a bottom end on an outside of the side portion 213 and a box roller 216 may be installed at a bottom corner at a rear end on the outside of the side portion 213. Functions of the rail portion 215 and the box roller 216 will be described below. A lifting member 25 may be mounted on a top edge of the side portion 213. The lifting member or lifter 25 lifts the box cover 23 when the storage box 21 is withdrawn forward. In detail, the lifting member 25 may include a front lifter 251 disposed approximately at a center of the side portion 213 or at a point slightly slanting backward from the center and a rear lifter 252 disposed in the rear end of the side portion 213. Similarly, the lifting member 25 may be provided on the opposite side portion or panel.

The center of the side portion 213 means a portion through which a vertical plane which may divide equally the side portion 213 into a front and a rear portions. The front lifter 251 may be disposed at the point which slightly slants backward from the center. In more detail, the front lifter 251 may be disposed at a point in which the front lifter 251 is not exposed outward even when the storage box 21 is maximally withdrawn forward. That is, the center of the side portion 213 or the point which slightly slants backward or offset from the center may be defined as a point in which the front lifter 251 is not externally exposed at a point where the storage box cannot be withdrawn further.

A height of the front lifter 251 which protrudes upward from the top surface or edge of the storage box 21 is identical to a height of the rear lifter 252 while a width of the rear lift 252 forward and backward may be larger than a width of the front lift 251 forward and backward. A reason thereof will be described below with reference to the drawings. Here, the widths of the lifts 251 and 252 forward and backward mean widths which extend in a direction of the front and rear of the storage box 21.

A top front corner and a top rear corner of each of the front lifter 251 and the rear lifter 252 may be rounded at a certain curvature to minimize a frictional force which occurs at a surface in contact with the box cover 23. A distance between the front lifter 251 and the rear lifter 252 may be a distance to prevent the box cover 23 from slanting or moving forward or backward while the storage box 21 is being withdrawn.

For example, when the front lifter 251 and the rear lifter 252 are disposed in the rear of the point, which divides equally the box cover 23 into the front and rear and the distance between the lifts 251 and 252 is too small, a moment may occur at the box cover 23 when the storage box 21 is being withdrawn or inserted. As the box cover 23 slants forward or backward, the front end or rear end of the box cover 23 may be in contact with the top surface of the storage box 21 and may generate a noise while the storage box 21 is moving.

The side portion 213 of the storage box 21 inclines to allow a height thereof to be reduced toward the rear. A top surface of the side portion 213 inclines downward toward the rear. In other words, the vertical height of the front portion 212 may be greater than a vertical height of rear portion 214. The front lifter 251 and the rear lifter 252 protrude in a direction which vertically intersects at the top surface of the side portion 213. Accordingly, each of the front lifter 251 and the rear lifter 252 is at a certain angle $\phi$ to a vertical plane V. Tilt angles of the front lifter 251 and the rear lifter 252 to the vertical V may be identical to a tilt angle of the top surface of the side portion 213 to a horizontal. In other words, the lifters protrude perpendicularly to the inclined angle of the top surface or edge of the side portion 213, but is at angle $\phi$ relative to the vertical plane V.

As described above, since the top surface or top edge of the side portion 213 of the storage box 21 is formed to slant downward, due to a vector component which operates on the slanting top surface of the storage box 21, a force necessary for withdrawing the storage box 21 is smaller than when the top surface of the storage box 21 is level. Additionally, compared with a case in which the storage box 21 and the box cover 23 are in horizontal contact with each other, contact performance is better when the storage box 21 and the box cover 23 are in contact with each other in a slanting state. In an aspect of a sealing force, it is more advantageous to be in contact in the slanting state.

Figure 6:
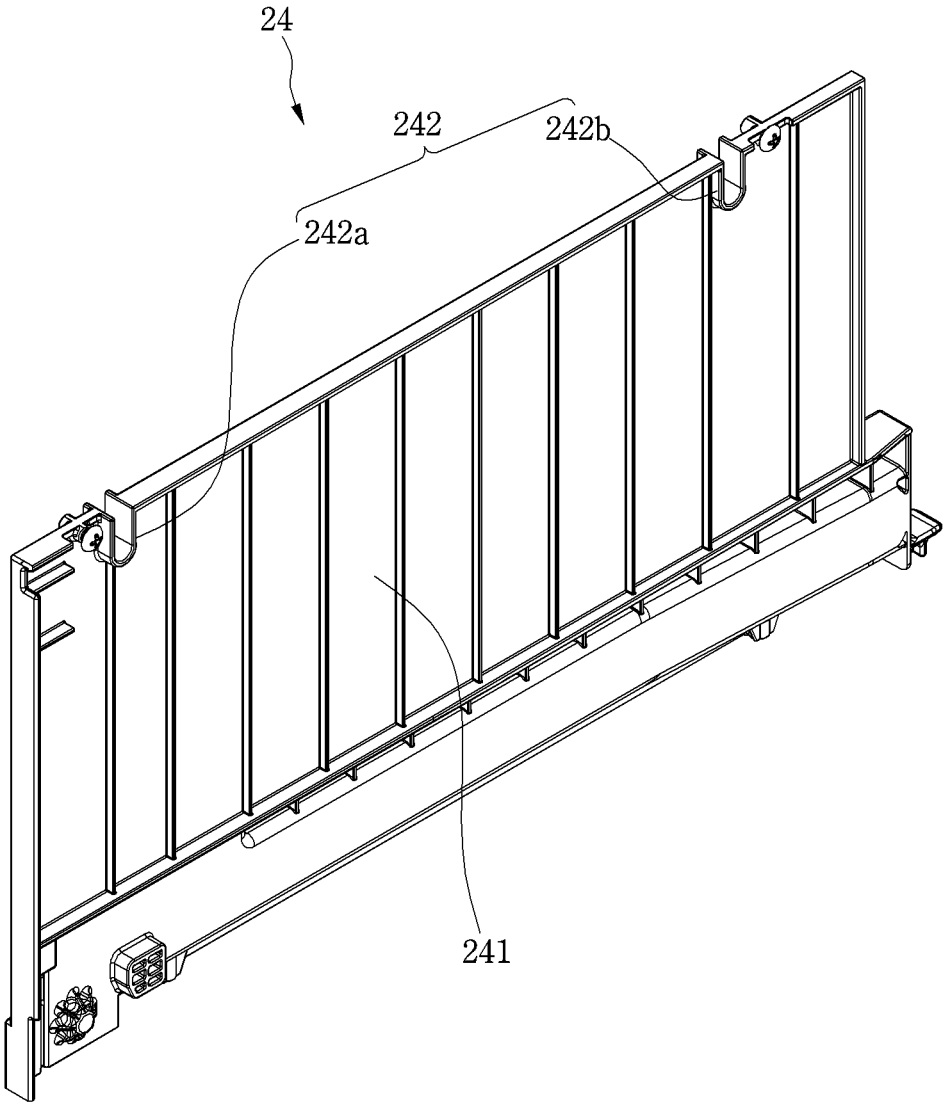
FIG. 6 is a perspective view illustrating an outer surface of a side wall constituting the storage box assembly according to an embodiment.
Figure 7:
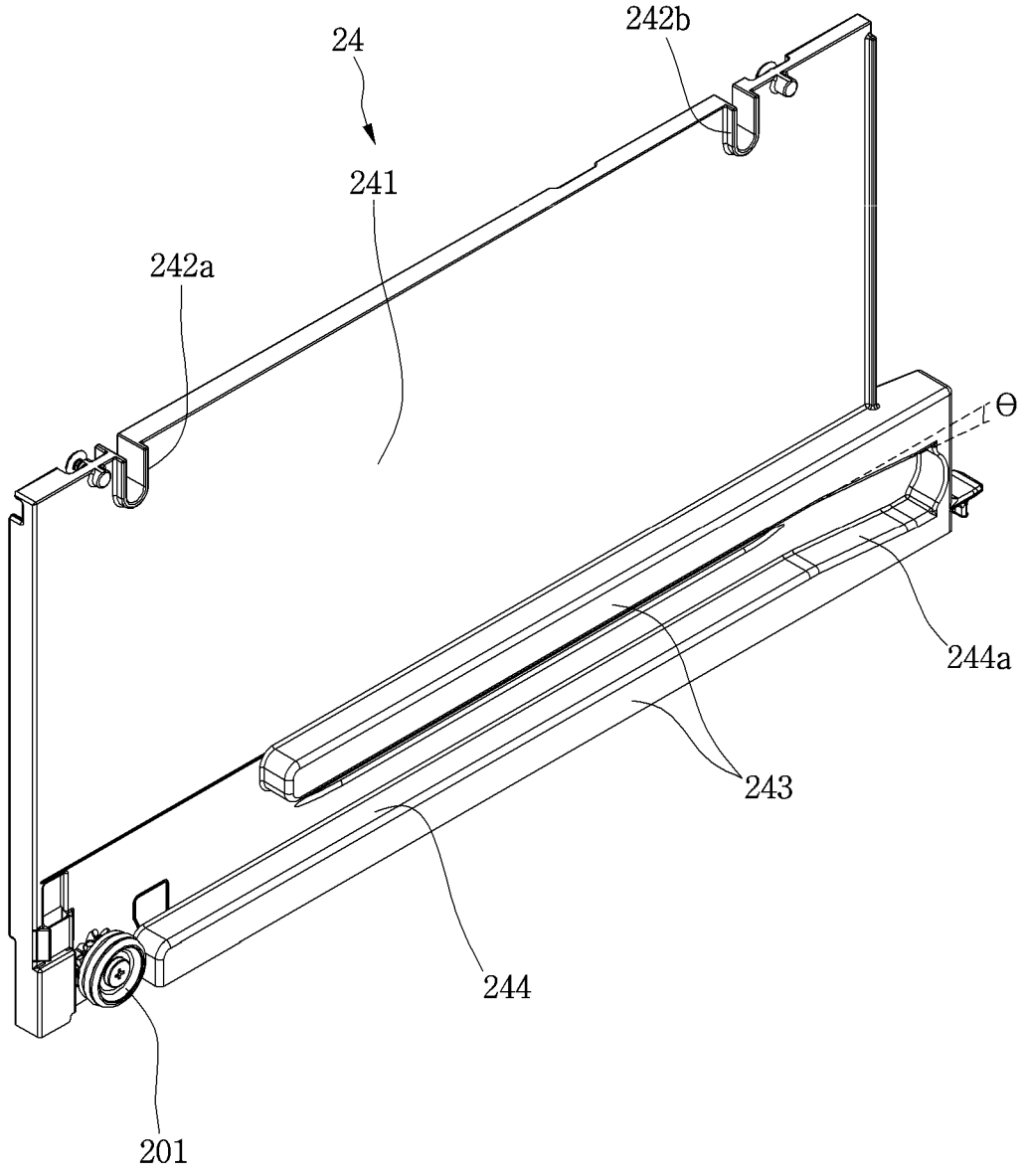
FIG. 7 is a perspective view illustrating an inner surface of the side wall.

FIG. 6 is a perspective view illustrating an outer surface of the side wall 24 constituting the storage box assembly 20 according to an embodiment. FIG. 7 is a perspective view illustrating an inner surface of the side wall 24. The side wall 24 constituting the storage box assembly 20 stands upright on an edge of a side of the base plate 26. Also, the storage table 100 is seated on a top surface of the side wall 24 and the storage box 21 is accommodated inside a space defined by the housing 22 and the storage table 100. The box cover 23 moves upward and downward while the storage box 21 is being inserted or withdrawn but moves upward only to a height not to interfere with the storage table 100 to prevent a noise from being generated when the storage table 100 and the box cover 23 collide with each other.

The side wall 24 may include a wall body 241 having an approximate rectangular shape, a rail guide rib 243 which protrudes from a bottom inside of the wall body 241 to form a rail guide or a rail guide portion 244, and a guide roller 201 provided at the bottom inside of the wall body 241. The rail guide rib 243 protrudes from a side facing the side portion 213 of the storage box 21. A pair of ribs extend forward and backward from points spaced at a certain interval to certain lengths, thereby forming the rail guide portion 244 therein. The rail guide portion 244 accommodates the rail portion 215 which protrudes from the side of the storage box 21.

The guide roller 201 is disposed in front of the rail guide rib 243, and in particular, in front of a lower guide rib, i.e., a lower one of the pair of ribs constituting the rail guide rib 243. A bottom surface of the rail portion 215 is seated on the guide roller 201. When the storage box 21 is inserted into or withdrawn from the housing 22, the rail portion 215 moves into the rail guide portion 244 or is withdrawn from the rail guide portion 244 while being seated on the guide roller 201. As the storage box 21 moves, the guide roller 201 rotates forward and backward, and the box roller 216 mounted on a rear bottom end of the side portion 213 of the storage box 21 moves forward and backward along the rail guide portion 244. For the side wall 24 standing upright at the center of the base plate 26 and supporting two storage boxes, the rail guide portion 244 and the guide roller 201 may be provided at both the inside and outside of the side wall 24.

The pair of ribs constituting the rail guide rib 243 are mutually connected at rear ends thereof, thereby forming a rear end of the rail guide portion 244 to be blocked. A front end of the rail guide portion 244 is open to guide the rail portion 215 into the rail guide portion 244 and the rear end is blocked to limit the insertion of the storage box 21. When the box roller 216 of the storage box 21 is in contact with the rear end of the rail guide portion 244, the storage box 21 is maximally inserted into the space defined by the housing 22 and the storage table 100.

A part of a rear area of the rail guide portion 244 slants downward from a horizontal plane at a certain angle $\theta$ in such a way that the storage box 21 may be automatically inserted into the housing 22 after being inserted to a certain distance. A slanting portion or rib 244*a* slants downward to the rear end may be formed at a point on a rear side of the rail guide portion 244 and may slant downward within a range from about 4.5° to about 5.5°. The slanting portion 244*a* may be designed to slant downward at about 5.1°. When the box roller 216 moves backward along the rail guide portion 244 and enters the slanting portion 244*a*, the rear end of the storage box 21 slants downward. As a result thereof, rear surfaces of left and right edges of the front portion 212 of the storage box 21 are in close contact with the entire surface of the side wall 24.

A hinge groove 242 is depressed at a certain depth in the top surface of the side wall 24 and a cover hinge 235 (refer to FIG. 8) of the box cover 23 is disposed in the hinge groove 242. The hinge groove 242 may include a front hinge groove 242*a* formed adjacent to a front end of the side wall 24 and a rear hinge groove 242*b* formed adjacent to a rear end of the side wall 24. The front hinge groove 242*a* and the rear hinge groove 242*b* may have the same depth.

Figure 8:
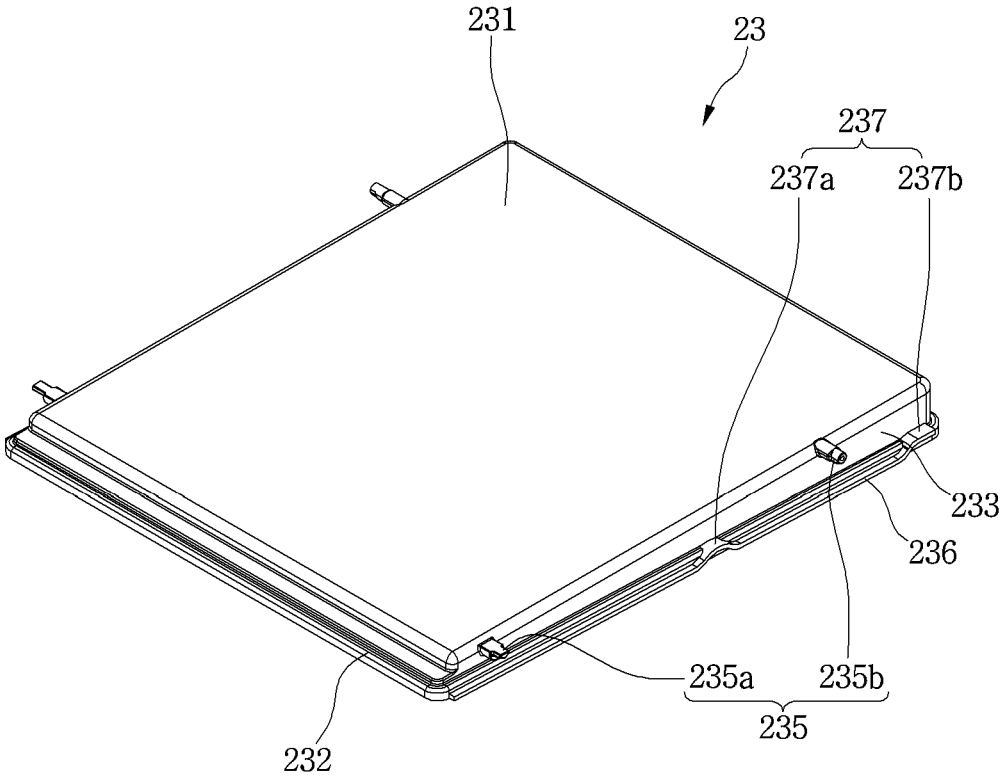
FIG. 8 is a top perspective view of a box cover constituting the storage box assembly according to an embodiment.
Figure 9:
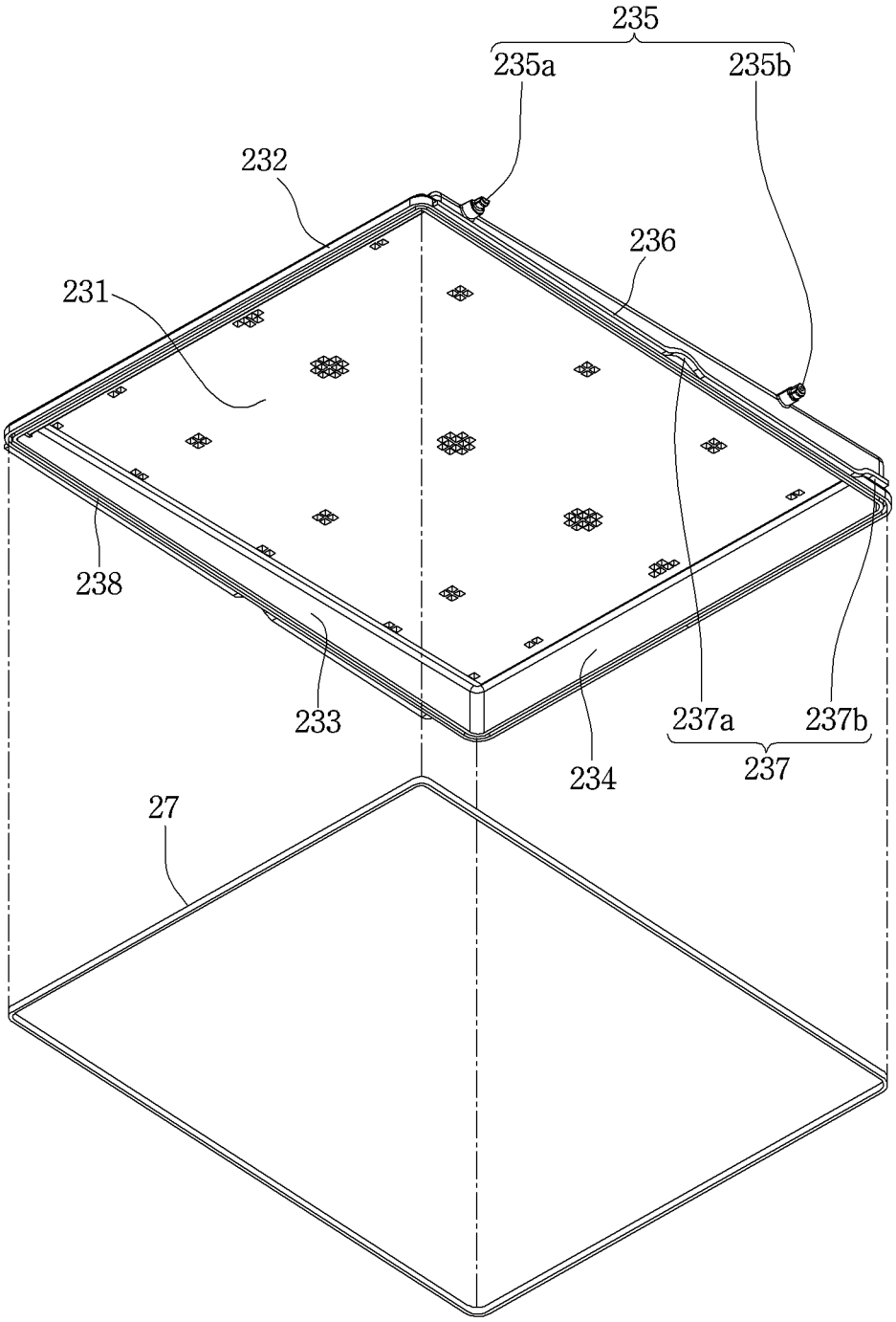
FIG. 9 is a bottom perspective view of the box cover.
Figure 10:
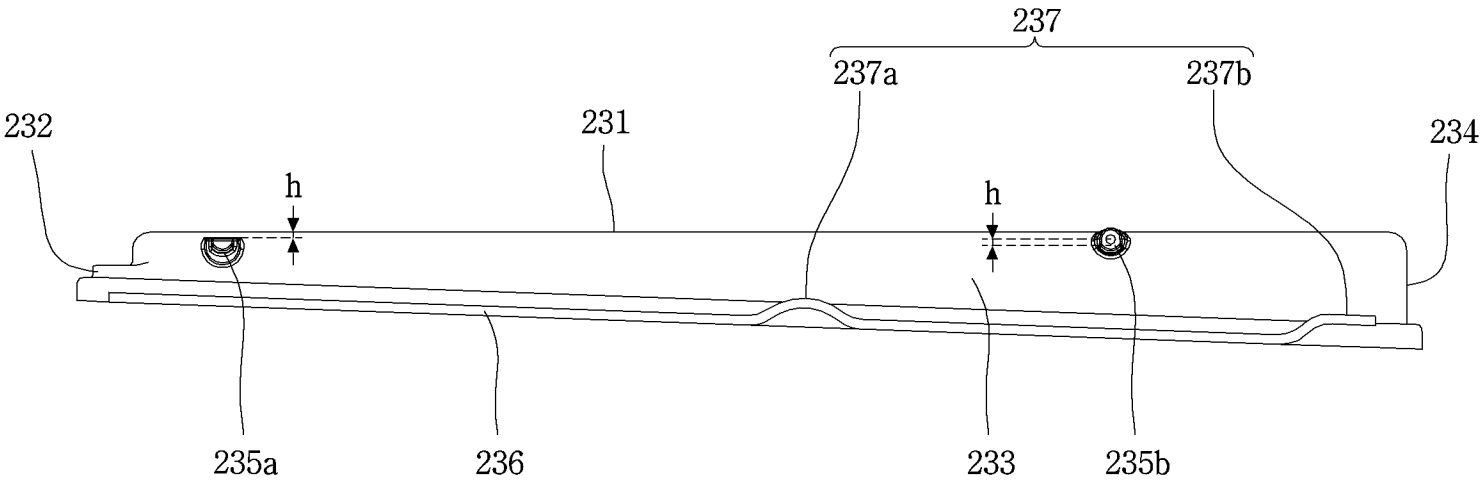
FIG. 10 is a side view of the box cover.

FIG. 8 is a top perspective view of the box cover 23 constituting the storage box assembly 20 according to an embodiment. FIG. 9 is a bottom perspective view of the box cover 23. FIG. 10 is a side view of the box cover 23. The box cover 23 includes a cover or cover body 231 having an approximate quadrilateral shape, a front or front portion 232 which extends downward from a front end of the cover body 231, sides or side 233 which extend downward from left and right edges of the cover body 231, and a rear portion 234 which extends downward from a rear or rear end of the cover body 231.

The side portion 233 of the box cover 23 slants downward toward a rear thereof to be in precisely close contact with the top surface of the storage box 21. A height of a front end of the side portion 233 of the box cover 23 is smaller than a height of a rear end. Cover hinges 235 protrude from both side portions 233 of the box cover 23. The cover hinges 235 each include a front hinge 235*a* which protrudes from the front end of the box cover 23 and a rear hinge 235*b* which protrudes from the rear end of the box cover 23. The front and rear hinges may be protrusions, and the protrusions may be rollers or pins. The front hinge 235*a* is seated in the front hinge groove 242*a* of the side wall 24 and the rear hinge 235*b* is seated in the rear hinge groove 242*b* of the side wall 24.

The rear hinge 235*b* is located higher than the front hinge 235*a* by a certain length h. This is because the depths of the front hinge groove 242*a* and the rear hinge groove 242*b* are identical but the rear end of the storage box 21 is lower than the front end. In other words, due to the slanting portion 244*a* defined in the rear of the rail guide portion 244 formed on the side wall 24, the rear end of the storage box 21 is lower than the front end while the storage box 21 is being completely inserted into the housing 22. To allow a bottom surface of the box cover 23 to be in completely close contact with the top surface of the storage box 21, it is necessary that the rear end of the box cover 23 is located lower than the front end. Accordingly, it is necessary to form the box cover 23 to slightly slant downward toward the rear by forming the rear hinge 235*b* at a point higher than the front hinge 235*a*.

When the rear hinge groove 242*b* is deeper than the front hinge groove 242*a*, it is possible to form the front hinge 235*a* and the rear hinge 235*b* at the same height. At a point in time when the box roller 216 of the storage box 21 moves out of the slanting portion 244*a* and enters the leveled rail guide portion 244, the top surface of the box cover 23 becomes level.

Cover rails or flanges 236 extend from bottoms of both sides of the box cover 23 with certain widths from the front end of the box cover 23 to the rear end. Each of the cover rails 236 also included a lift groove 237. In detail, the lift groove 237 is a depressed portion formed to allow the lifting member 25 to be seated therein and may include a front lift groove 237*a* into which a protruding portion of the front lifter 251 is inserted, and a rear lifter groove 237*b* into which a protruding portion of the rear lifter 252 is inserted.

The front lift groove 237*a* is rounded convex upward and the protruding portion of the front lift 251 is inserted into a groove formed below the front lift groove 237*a*. The rear lift groove 237*b* is formed at a rear end of the cover rail 236 in an upward-stepped shape. In detail, unlike the front lift groove 237*a*, the rear lift groove 237*b* has a stepped shape having an open rear end instead of being convexly stepped upward and bent or rounded downward. Since the cover rail 236 has a stepped shape which is bent upward and extends to the rear end of the box cover 23, the rear end of the rear lift groove 237*b* is open.

The rear lift groove 237*b* may have a size to partially accommodate the rear lifter 252. Since the rear end of the cover rail 236 partially covers a top surface of the rear lifter 252, even when the storage box 21 is strongly pushed, it is possible to prevent the rear end of the cover rail 236 from colliding with the rear lifter 252 and being damaged. A gasket groove 238 is depressed in the bottom surface of the box cover 23 and a gasket 27 is inserted into the gasket groove 238.

Figure 11:
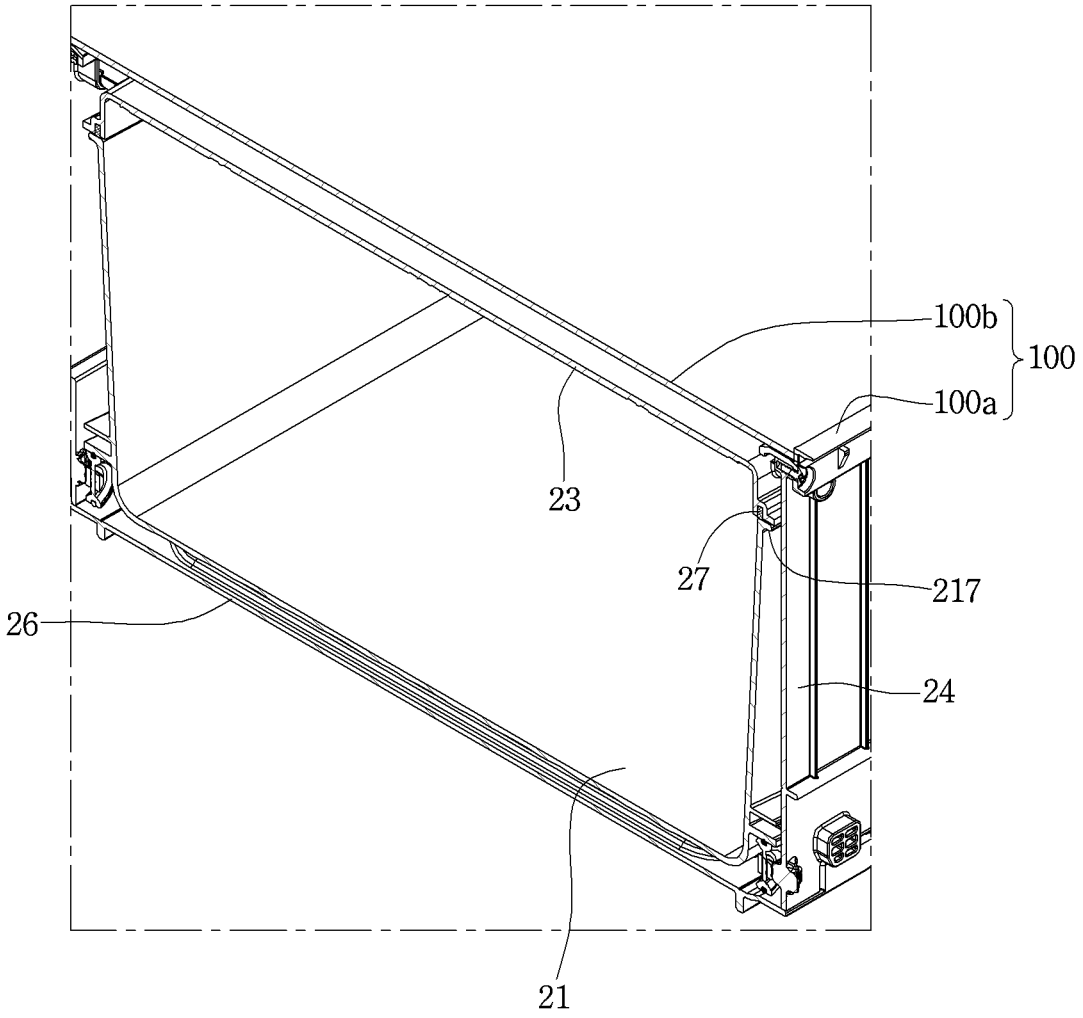
FIG. 11 is a longitudinal cross-sectional view illustrating a portion taken along line I-I shown in FIG. 3.

FIG. 11 is a longitudinal cross-sectional view illustrating a portion taken along line I-I shown in FIG. 3. The side wall 24 stands straight at the edge of the side of the base plate 26 and the storage table 100 is seated on the top surface of the side wall 24. The frame 100 *a* constituting the storage table 100 is seated on the top surface of the side wall 24 and the panel 100*b* is seated on and coupled with the frame 100 *a*.

A flange 217 horizontally bent outward from the storage box 21 is formed at a top end of the storage box 21 and is in close contact with the cover rail 236 of the box cover 23. The cover rail 236 is seated on the flange 217. The gasket 27 mounted on the bottom surface of the box cover 23 is in close contact with the flange 217 to completely seal an inner space of the storage box 21.

Figure 12:
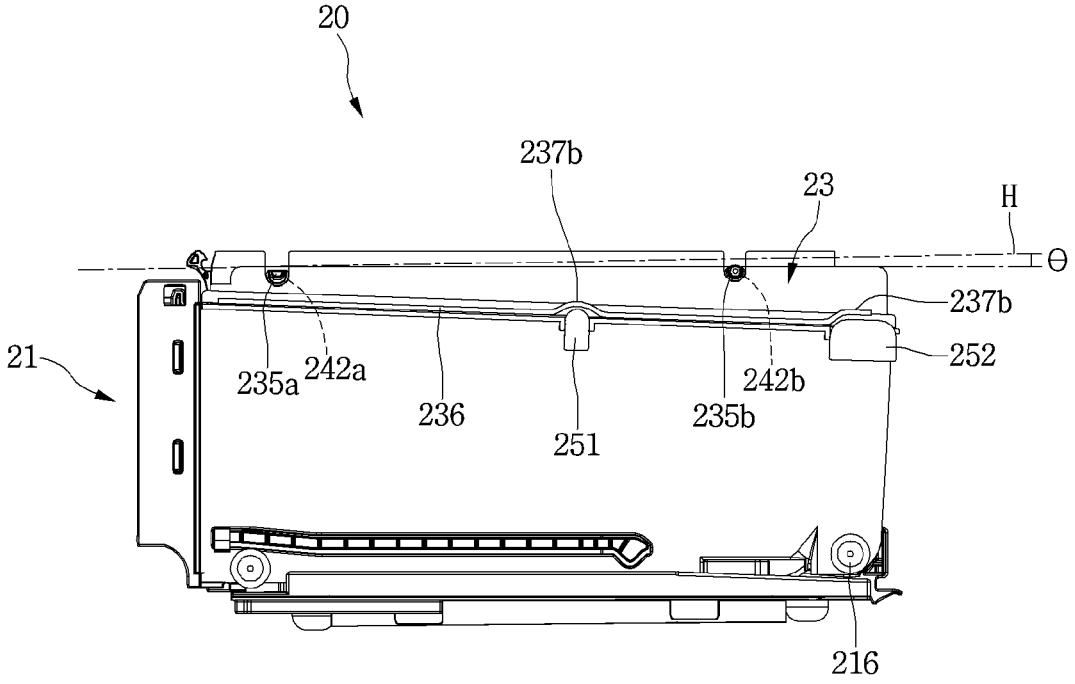
FIG. 12 is a side view of the storage box assembly in a state in which the storage box is completely inserted into a housing.
Figure 13:
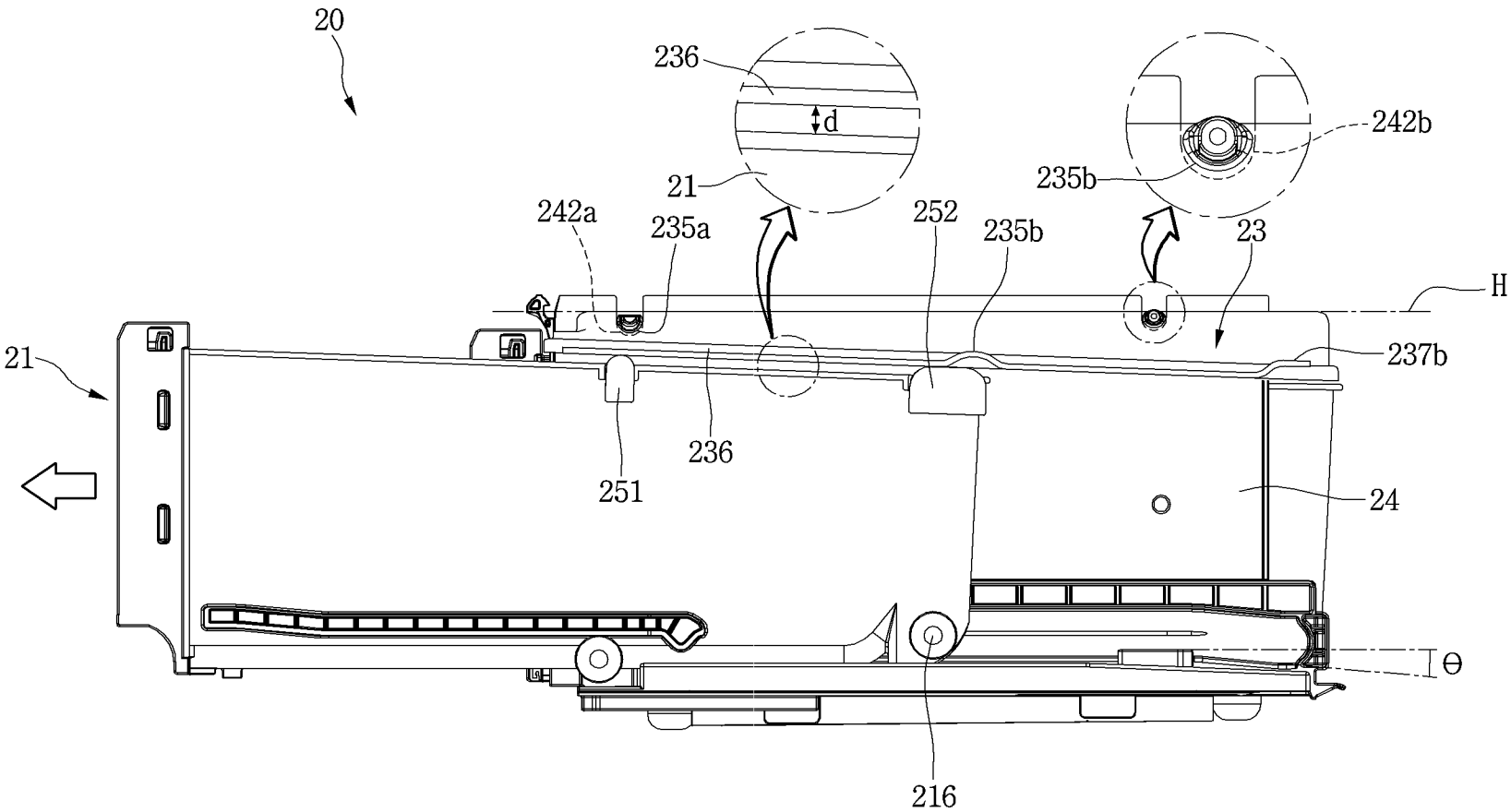
FIG. 13 is a side view of the storage box assembly in a state in which the storage box is maximally withdrawn from the housing.

FIG. 12 is a side view of the storage box assembly 20 in a state in which the storage box 21 is completely inserted into the housing 22. FIG. 13 is a side view of the storage box assembly 20 in a state in which the storage box 21 is maximally withdrawn from the housing 22.

When the storage box 21 is completely inserted into the housing 22, the front lifter 251 is accommodated in the front lift groove 237*a* and the rear lifter 252 is accommodated in the rear lift groove 237*b*.

The width of the front lifter 251 may be smaller than the width of the rear lifter 252 to allow the rear lifter 252 to pass the front lift groove 237*a* without fitting into the front lift groove 237*a* while the storage box 21 is withdrawn forward. When the rear lifter 252 fits into the front lifter groove 237*a*, the rear lifter 252 may collide with the box cover 23 and may generate a noise while the storage box 21 is being withdrawn. In addition, the storage box 21 may be held for a while and unable to be withdrawn in such a way that the user has to pull the storage box 21 with much force. To prevent such a phenomenon, the width of the rear lifter 252 may be at least greater than the width of a bottom end of the front lift groove 237*a* in such a way that the rear lifter 252 may smoothly pass the front lift groove 237*a*.

Front top corners and rear top corners of the lifters 251 and 252 are also formed to be rounded to allow the lifters 251 and 252 to move out of the lift grooves 237*a* and 237*b* without a noise and to minimize friction. When the storage box 21 is completely inserted into the housing 22, it is maintained that the cover hinge 235 is seated in the hinge groove 242 of the side wall 24. In this state, it is maintained that the top surface of the box cover 23 slants downward from a horizontal H to the rear at a certain angle θ.

Referring to FIG. 13, when the storage box 21 is withdrawn forward, the front lifter 251 and the rear lifter 252 move out of the front lift groove 237*a* and the rear lift groove 237*b*, respectively. Top surfaces of the lifters 251 and 252 move forward while being in contact with bottom surfaces of the cover rails 236 of the box cover 23. When the storage box 21 is withdrawn forward, the cover rail 236 and the flange 217 of the storage box 21 are spaced from each other at a certain distance d. The distance d corresponds to a height of the lifting member 25 protruding from the top surface of the storage box 21. When the storage box 21 is withdrawn, the cover hinge 235 is certainly spaced from a bottom of the hinge groove 242 at a certain distance d.

When the box roller 216 moves along the slanting portion 244*a*, the top surface of the box cover 23 is maintained as slanting downward from the horizontal H. At a point in time when the box roller 216 moves out of the slanting portion 244*a*, the top surface of the box cover 23 becomes level. When the storage box 21 is maximally withdrawn from the housing 22, the front lifter 251 is covered by the box cover 23 and is not exposed outward. The front lifter 251 is not exposed outward even when the storage box 21 is maximally withdrawn, which may prevent the front lifter 251 from being damaged or foreign substances from being held by the front lifter 251.

Figure 14:
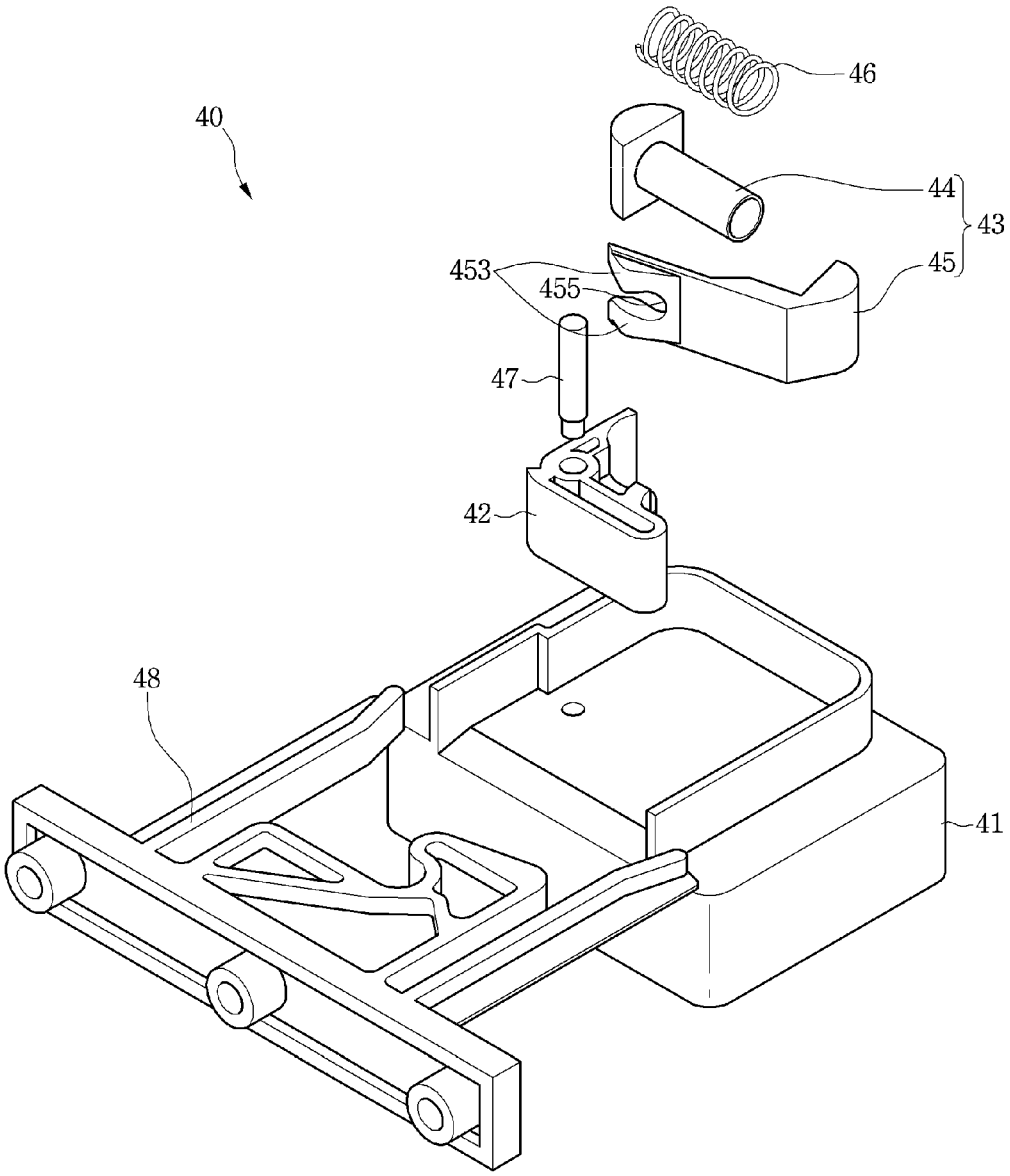
FIG. 14 is an exploded perspective view of an auto closing unit constituting the storage box assembly according to an embodiment.
Figure 15:
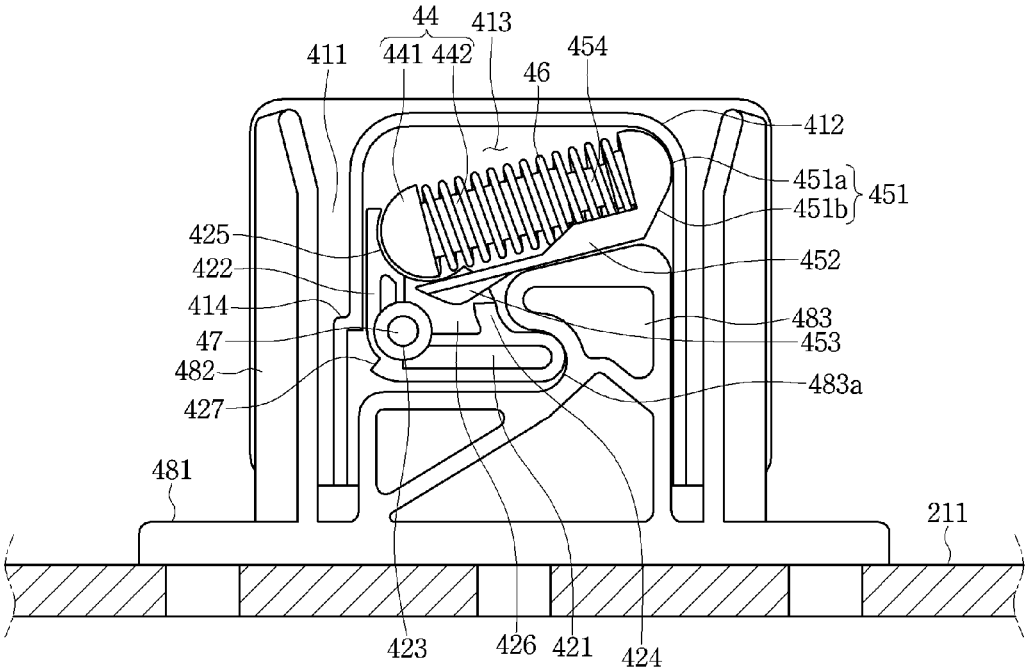
FIG. 15 is a top view of the auto closing unit.

FIG. 14 is an exploded perspective view of the auto closing unit or module 40, or latching mechanism, constituting the storage box assembly 20. FIG. 15 is a top view of the auto closing unit 40. The auto closing unit 40 may include a slide base 41 fixed to the bottom surface of the housing 22, a latch head 42 pivotably coupled with a top surface of the slide base 41 by a hinge axis or shaft 47, a latch body 43 pivotably connected with the latch head 52, a spring 46 coupled with the latch body 43, and a holding member 48 fixed to the rear end of the bottom portion 211 of the storage box 21.

The holding member 48 slidably moves over the top surface of the slide base 41 according to forward and backward movement of the storage box 21. The latch body 43 may include a first body 44 multi-joint-coupled with the latch head 42 and a second body 45 connected with the first body 44. The spring 46 is put on the first body 44.

When the storage box 21 is completely inserted into the housing 22, as shown in FIG. 15, the holding member 48 is maintained as being held by the latch head 42. A combination of the latch head 42, the hinge axis 47, the latch body 43, and the spring 46 may be designated as a latch member. The auto closing unit 40 may be defined to include the slide base 41, the latch member disposed on the slide base 41, and the holding member 48 fixed to the storage box 21 and selectively coupled with the latch member.

Referring to FIG. 15, the holding member 48 may include a bracket 481 fixed to the rear end of the bottom portion 211 or the rear portion 214 of the storage box 21, a pair of guide ribs 482 which extend from a rear surface of the bracket 481, and a hook 483 which extends from the rear surface of the bracket 481 corresponding to a space between the pair of guide ribs 482. A latch groove 483*a* is depressed in one side of the hook 483.

The slide base 41 protrudes at a height corresponding to a distance between the bottom surface of the housing 22 and the bottom portion 211 of the storage box 21 and includes a sliding surface 411 on the top surface. The guide rib 482 of the holding member 48 slides forward and backward while being in contact with the sliding surface 411.

An n-shaped partitioning rib 412 may be formed on the top surface of the slide base 41, an inside of the partitioning rib 412 may be defined as a latch accommodating portion 413, and an outside thereof may be defined as the sliding surface 411. Also, a front end of the latch accommodating portion 413 is open to allow the hook 483 to be inserted therein. Also, one side of the partitioning rib 412 is stepped to form a holding lip 414.

The latch head 42 constituting the latch member includes a hinge hole 423 through which the hinge axis 47 penetrates. Also, the latch head 42 includes a holding protrusion 421 which extends to a certain length from the hinge hole 423 and is inserted into the latch groove 483*a* formed at the hook 483. The latch head 42 further includes a latch body connecting portion 422 which extends to a certain length from the hinge hole 423 in a direction which intersects with or is orthogonal to an extension direction of the holding protrusion 421.

A latch body contact surface 425 smoothly rounded at a certain curvature is formed at an end of the latch body connecting portion 422. A guide protrusion 424 may protrude from one side of the holding protrusion 421. The latch body connecting portion 422 and the holding protrusion 421 may be connected to each other by a holding plate 426. According to a configuration described above, the latch head 42 pivots on the hinge axis 47 clockwise or counterclockwise and the latch member pivots clockwise or counterclockwise interlocking with the rotation of the latch head 42.

A stopper 427 protrudes from an outer circumferential surface of the latch head 42, and in particular, from a corner area at which the holding protrusion 421 and the latch body connecting portion 422 intersect with each other. When the latch head 42 pivots clockwise and the stopper 427 is held by the holding lip 414 of the partitioning rib 412, the rotation of the latch head 42 is stopped.

The latch body 43, as described above, may include the first body 44 in surface contact with the latch body connecting portion 422 and the second body 45 rockably connected with the first body 44. The first body 44 may include a joint head 441 and a joint cylinder 442. The joint head 441 has a semicircular shaped cross section, and a circumferential surface thereof is in surface contact with the latch body contact surface 425 of the latch body connecting portion 422. When the latch head 42 pivots, the first body 44 pivots while the circumferential surface of the joint head 441 is being in contact with the latch body contact surface 425. The joint cylinder 442 may extend to a certain length from the joint head 441 and may have a hollow cylindrical shape. However, the joint cylinder 442 may have a polyprism shape.

The second body 45 may include a supporting boss 454 having a bar shape, a supporting portion 451 formed at an end of the supporting boss 454, and a pressurized portion 452 which extends parallel to the supporting boss 454 in the same direction at an edge of the supporting portion 451. In detail, the supporting portion 451 is a portion in surface contact with a corner area of the partitioning rib 412 and may include a curved portion 451*a* in close contact with the corner area of the partitioning rib 412 and a linear portion 451*b* which linearly extends from the curved portion 451*a*.

Due to a structure described above, when the first body 44 pivots, the curved portion 451*a* pivots while being in close contact with the corner area of the partitioning rib 412. The latch body 43 may pivot until the linear portion 451*b* becomes in contact with the partitioning rib 412.

The pressurized portion 452 is a portion pressurized by the hook 483 when the storage box 21 is inserted. A pair of interfering protrusions 453 may extend from an end of the pressurized portion 452 and an interfering groove 455 may be formed therebetween. The holding plate 426 of the latch head 42 is inserted into the interfering groove 455. Since the holding plate 426 is maintained being inserted into the interfering groove 455 at all times, a phenomenon in which the latch body 43 is separated from the latch head 42 while the latch body 43 and the latch head 42 are pivoting does not occur.

In the case of the auto closing unit 40 having the configuration described above, as shown in FIG. 15, when the storage box 21 is completely inserted into the housing 22, the hook 483 is held by the latch member, thereby completely closing the storage box 21 at all times. In this state, the supporting boss 454 is slightly out of the joint cylinder 442.

Figure 16:
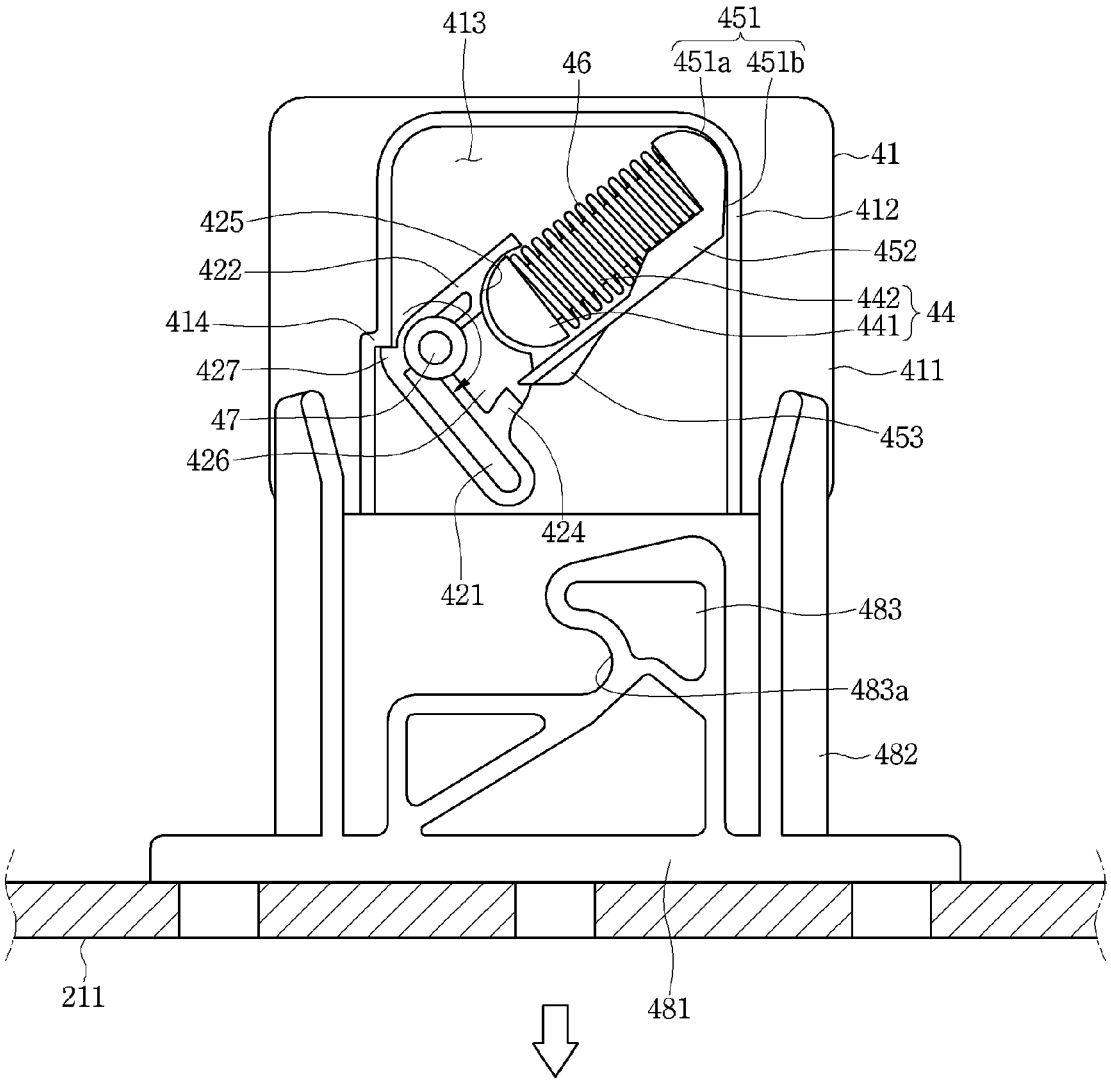
FIG. 16 is a plan view of the auto closing unit when the storage box is withdrawn.

FIG. 16 is a plan view of the auto closing unit 40 when the storage box 21 is initially withdrawn. When the storage box 21 starts being withdrawn from the housing 22, the holding member 48 moves together with the storage box 21 as a single body. The hook 483 pulls the holding protrusion 421 of the latch head 42 forward and pivots the latch head 42 on the hinge axis 47 clockwise.

As the latch head 42 pivots clockwise, the latch body 43 pivots on the supporting portion 451 counterclockwise. The latch body 43 pivots counterclockwise while being in close contact with the corner area of the partitioning rib 412. The latch head 42 continuously pivots in such a way that the latch body connecting portion 422 and the latch body 43 become in alignment with each other. In this state, the stopper 427 of the latch head 42 is held by the holding lip 414 of the partitioning rib 412 and simultaneously the linear portion 451*b* of the supporting portion 451 is in close contact with a linear area of the partitioning rib 412, thereby preventing the latch head 42 from pivoting.

In this state, the spring 46 is compressed to a minimal length. In other words, a restoring force stored in the spring 46 becomes a maximum. The holding protrusion 421 is already separated from the latch groove 483*a* of the hook 483. Accordingly, when the storage box 21 is withdrawn forward, the holding member 48 is released from the latch member. As the storage box 21 is withdrawn further, the end of the guide ribs 482 no longer overlaps with side block 41 due to the bracket 481 being coupled to the bottom portion 211 or rear portion 214.

When the user pulls the storage box 21 back to insert the storage box 21 into the housing 22, the hook 483 becomes closer to the latch member. Also, when the hook 483 pushes the pressurized portion 452, the latch head 42 pivots counterclockwise and the latch body 43 pivots clockwise. Then, the latch member in a linear state becomes bent at the joint head 441. The spring 46 also starts to elongate to an original position.

When bent states of the latch head 42 and the latch body 43 exceed a certain point in time, due to the restoring force of the spring 46, it automatically becomes the state shown in FIG. 15 even when a force of pushing the storage box 21 is removed. The storage box 21 is automatically completely closed due to the restoring force of the spring 46. Accordingly, when the user removes a closing force before the storage box 21 is completely pushed into the housing 22, the storage box 21 is completely closed, thereby providing a sealing force of the storage box 21.

As can be appreciated, a width of a rear lifter which lifts a box cover disposed on a top surface of a storage box is larger than a width of a front lifter, thereby preventing a phenomenon in which the rear lifter is held by a front lift groove to make a noise or to be damaged and smoothly withdrawing the storage box.

Even when the storage box is maximally withdrawn, the front lift is not exposed outward, thereby preventing the front lift from being damaged or preventing foreign substances from being held by the front lift.

An auto closing unit or auto latching mechanism is mounted between a bottom surface of the storage box and a housing, thereby completely inserting the storage box into the housing even when a user does not completely push the storage box.

A link constituting the auto closing unit vertically protrudes, thereby smoothly performing an auto closing function even when an assembling tolerance occurs between the bottom surface of the storage box and a bottom of the housing.

A storage box assembly according to an embodiment may include a housing including: a base plate; and side walls which stand straight at side edges of the base plate, each side wall comprising a front hinge groove and a rear hinge groove on a top surface thereof; a storage box accommodated in the housing, the storage box including: side surfaces of which upper ends are respectively slanted downward toward a rear end of the storage box; and front lifts and rear lifts protruding from the upper ends of the side surfaces, respectively; and a box cover covering a top surface of the storage box, the box cover including: both side surfaces of which bottom ends are slanted to be in close contact with the upper ends of the both side surfaces of the storage box, respectively; front and rear hinges which protrude from the both side surfaces and are seated in the front hinge groove and the rear hinge groove, respectively; cover rails which are bent at the bottom ends of the both side surfaces thereof to be in contact with the upper ends of the side surfaces of the box cover; and front and rear lift grooves which are respectively formed by depressing the cover rail upward at predetermined positions of the cover rail, and into which the front lift and the rear lift are respectively inserted when the storage box is completely received in the housing; and an auto closing unit disposed in a center of a bottom portion of the storage box and a center of a bottom portion of the housing, wherein the auto closing unit comprises: a holding member fixed to the bottom portion of the storage box; a slide base fixed to the bottom portion of the housing; a partitioning rib which surrounds a top surface of the slide base; and a latch member pivotably connected to the top surface of the slide base corresponding to an inner space of the partitioning rib and selectively connected to the holding member. A refrigerator according to an embodiment may include the storage box assembly described above.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A storage box assembly, comprising:

a housing including a base plate and first and second upright sidewalls at first and second side edges of the base plate, each upright sidewall having a front groove and a rear groove on a top surface;

a movable storage box accommodated in the housing, the storage box having first and second side panels, a bottom panel and an open top, each of the first and second side panels having an upper end slanted downward from a front end toward a rear end of the movable storage box such that the height of the front end is greater than the rear end, and having front and rear lifters protruding from the upper end; and a cover configured to cover the open top when the movable storage box is in a closed position within the housing, the cover including:

side surfaces having bottom ends which are slanted such that a front end of each side surface has a lower height than a rear end, front and rear protrusions which protrude from the each side surface and configured to seated in the front and rear grooves, respectively, first and second flanges at the bottom ends of both side surfaces, and front and rear lift recesses on both first and second flanges, the front and rear lift recesses facing the front and rear protrusions of the storage box such that the front and rear protrusions are seated in the front and rear lift recesses when the storage box is in the closed position.

2. The storage box assembly of claim 1, further comprising an auto latching mechanism to automatically close the movable storage box into the housing when the rear end of the storage box is proximate to a closed position, the auto latching mechanism including:

a holder fixed to a bottom of the movable storage box;

a slide base fixed to the bottom portion of the housing;

a partitioning rib which surrounds a top surface of the slide base; and a latch pivotably connected to the top surface of the slide base corresponding to an inner space of the partitioning rib and selectively connected to the holding member.

3. The storage box assembly of claim 1, wherein the holder comprises:

a bracket in close contact with the storage box;

a pair of guide ribs which extend from the bracket and move along the top surface of the slide base corresponding to an outside of the partitioning rib; and a hook which extends from a point of the bracket corresponding to a space between the pair of guide ribs.

4. The storage box assembly of claim 3, wherein the latch comprises:

a latch head connected to the top surface of the slide base and configured to pivot clockwise or counterclockwise with respect to a vertical hinge axis;

a latch body having one end in contact with the latch head and another end in contact with a corner area of the partitioning rib; and a spring placed on an outer circumferential surface of the latch body.

5. The storage box assembly of claim 4, wherein the latch body comprises:

a first body having a joint head in surface contact with the latch head, and a joint cylinder extending from the joint head and having a hollow cylindrical shape; and a second body having a supporting boss where one end is movably inserted into the joint cylinder, a support having at least a part of which is rounded to be in close contact with a corner area of the partitioning rib, and a spring which extends from the support, wherein the spring is placed on an outer circumferential surface of the joint cylinder.

6. The storage box assembly of claim 5, wherein the latch head and the latch body pivot on the joint head and are bent when the storage box is completely inserted into the housing, and a holding protrusion of the latch head held by the latch groove.

7. The storage box assembly of claim 6, wherein the latch head and the latch body pivot and are in alignment with each other, and the spring is compressed to store a maximum restoring force when the storage box is separated from the housing.

8. The storage box assembly of claim 1, wherein a width of the rear lifter is larger than a width of the front lifter.

9. The storage box assembly of claim 8, wherein when the movable storage box is withdrawn to maximum open position, each of the front lifters are covered by the cover.

10. The storage box assembly of claim 9, wherein the front lift groove has convex contour such that a portion of the first and second flanges sequentially moves upward and downward, and the rear lift groove has a stepped shape and has an open rear end.

11. The storage box assembly of claim 8, further comprising:

rails protruding from the both side panels of the movable storage box and extending in a front-to-rear direction of the movable storage box; and rail guides formed on the upright sidewalls to guide the movement of the rails, wherein a rear part of the rail guides is inclined downwards at a prescribed angle.

12. The storage box assembly of claim 11, wherein the front groove and the rear groove have the same depth, and the rear protrusion is formed at a point higher than the front protrusion.

13. The storage box assembly of claim 11, wherein the rear groove has a greater depth than the front groove, and the front and rear protrusions are formed at the same height.

14. The storage box assembly of claim 1, wherein the front lifter and the rear lifter protrude in a direction orthogonal to the upper ends of the side panels such that the front and rear lifters are inclined relative to a vertical plane.

15. A refrigerator comprising:

a cabinet having a storage space therein;

a door to selectively open and close the storage space; and a storage box assembly according to claim 1, which is installed in one side of the storage space.

* * * * *